United States Patent [19]

Nagase

[11] 4,414,943

[45] Nov. 15, 1983

[54] METHOD OF AND APPARATUS FOR CONTROLLING THE AIR INTAKE OF AN INTERNAL COMBUSTION ENGINE

[75] Inventor: Masaomi Nagase, Toyota, Japan

[73] Assignee: Toyota Jidosha Kogyo Kabushiki Kaisha, Toyota, Japan

[21] Appl. No.: 303,107

[22] Filed: Sep. 17, 1981

[30] Foreign Application Priority Data

Sep. 24, 1980 [JP] Japan ..... 55-131454

[51] Int. Cl.[3] ..... F02D 9/02; F02D 31/00

[52] U.S. Cl. ..... 123/339; 123/588; 364/431.07

[58] Field of Search ..... 123/339, 585, 588, 589, 123/179 G; 364/431.07

[56] References Cited

U.S. PATENT DOCUMENTS 4,344,399 8/1982 Matsumura et al. ..... 123/339

*Primary Examiner*—Tony M. Argenbright

*Attorney, Agent, or Firm*—Cushman, Darby & Cushman

[57] ABSTRACT

The sectional area of a bypass passage which is bypassing a throttle valve in an intake passage of an internal combustion engine is determined to a specific value during starting. The specific value is obtained by adding an increment value to a base value which corresponds to an optimum value of the sectional area in the stable idling condition.

10 Claims, 9 Drawing Figures

| Fig. 2A |
| --- |
| Fig. 2B |

METHOD OF AND APPARATUS FOR CONTROLLING THE AIR INTAKE OF AN INTERNAL COMBUSTION ENGINE

BACKGROUND OF THE INVENTION

The present invention relates to a method of controlling the flow rate of air intake of an internal combustion engine, particularly as it relates to an air intake control method during the idling condition.

There is known a method of controlling the air intake of an internal combustion engine when a throttle valve disposed in an intake passage is at the fully closed position. According to this conventional method, the flow rate of intake air, when the throttle valve is fully closed, is controlled by adjusting a control valve disposed in an air bypass passage which communicates with the intake passage on opposite sides of the throttle valve. Such an air intake control method is usually employed for controlling the idling rotational speed of the engine. The idling rotational speed can be controlled by a closed loop if the bypass control valve is adjusted to conrol the flow rate of the air sucked into the engine through the bypass passage so that the detected actual rotational speed of the engine becomes equal to the desired idling rotational speed.

However, according to the conventional air intake control method, the position of the bypass control value is always maintained at a valve equal to an optimum openin degree in a stable idling condition, even when the engine is in the starting condition. Therefore, if the throttle valve is at the fully closed position, a sufficient flow rate of intake air cannot be obtained during starting and just after starting, causing the rotational speed to be slow. As a result, difficulty in starting the engine may sometimes occur. Furthermore, if the engine runs slowly even after starting, the driver will feel uneasy about the start of the engine. This is because the driver usually recognizes that the rotational speed of the engine is high when the engine is first started. The engine may sometimes stall if a large load is applied to an engine which is running slowly, just after starting.

SUMMARY OF THE INVENTION

It is, therefore, an object of the present invention to provide a method of and apparatus for controlling the air intake of an internal combustion engine, whereby the starting performance of the engine can be enhanced even when the throttle valve is fully closed.

Another object of the present invention is to provide an air intake control method and apparatus, whereby the rotational speed can be smoothly controlled to the desired idling rotational speed without stalling, just after starting or re-starting.

A further object of the present invention is to provide an air intake control method and apparatus, whereby a remarkably improved driving feeling can be obtained during starting and after starting.

According to the present invention, a determination is made as to whether the engine is in the starting condition or not, to produce a starting condition signal. In response to the starting condition signal, when the engine is in the starting condition, a value of a control output signal is calculated by adding an increment value to a base value which corresponds to an optimum control output signal value in the stable idling condition. When the engine is in the starting condition, the sectional area of an air bypass passage which bypasses the throttle valve is adjusted in response to the control output signal calculated during the starting condition, to control the flow rate of air drawn through the air bypass passage.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
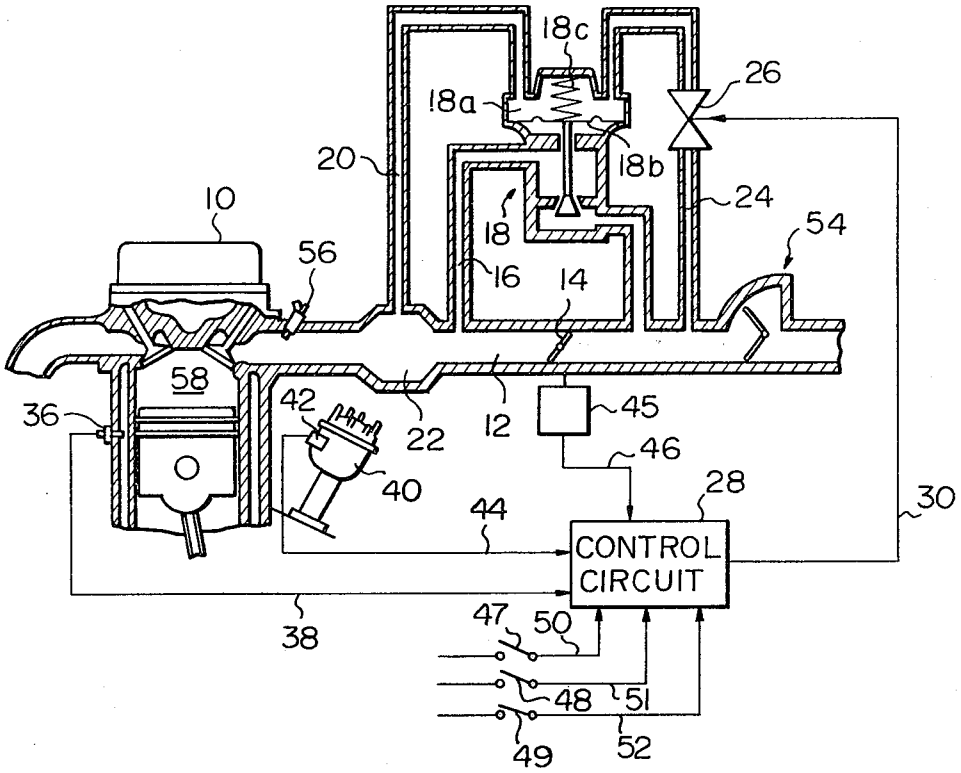
FIG. 1 is a schematic diagram illustrating a system in which the method of the present invention is used.

Referring to FIG. 1, in which an example of an electronic fuel injection control system of an internal combustion engine, according to the method of the present invention, is illustrated, a reference numeral 10 denotes an engine body, and 12 denotes an intake passage. A throttle valve 14 is disposed in the intake passage 12.

An air control valve (ACV) 18 is provided in an air bypass passage 16 which interconnects the intake passage 12 upstream of the throttle vallve 14 with the intake passage 12 downstream of the throttle 14. The ACV 18 operates responsive to a vacuum pressure which is applied to a diaphragm chamber 18*a*, and controls the flow rate of air which passes through the air bypass passage 16. Namely, as the vacuum pressure increases in the diaphragm chamber 18*a*, a diaphragm 18*b* is pulled against a spring 18*c*, and the cross-sectional area of the flow passage is reduced to decrease the flow rate of the bypass air. Contrary to this, as the vacuum pressure decreases in the diaphragm chamber 18*a*, the diaphragm 18*b* is pushed by the spring 18*c*, whereby the cross-sectional area of the flow passage is increased to increase the bypass of air flow rate.

The diaphragm chamber 18*a* of the ACV 18 is communicated, via a conduit 20, with a surge tank 22 which is located on the downstream side of the throttle valve 14, and is further communicated with the intake passage 12 on the upstream side of the throttle valve 14 via a conduit 24. A vacuum pressure switching valve (VSV) 26 is disposed in the conduit 24. The VSV 26 is operated by electrical signals that are sent from a control circuit 28 via a line 30 to control the vacuum pressure in the diaphragm chamber 18*a* of the ACV 18. Namely, as the VSV 26 is energized by an electrical current, the path opens so that the air is permitted to flow into the diaphragm chamber 18*a* to decrease the vacuum pressure.

A coolant temperature sensor 36 is disposed in the cylinder block of the engine to detect the temperature of the coolant, and an analog voltage which represents the detected coolant temperature is sent to the control circuit 28 via a line 38.

A distributor 40 is provided with a crank angle sensor 42 which produces a pulse at every predetermined angle rotation, for example, every time the crank shaft turns by 30° CA. The produced pulses are sent to the control circuit 28 via a line 44.

A throttle position sensor 45 is attached to the rotary shaft of the throttle valve 14 to detect if the throttle valve 14 is at the idling position (fully closed position). The electrical signal, which represents the detected result, is fed to the control circuit 28 via a line 46.

The control circuit 28 further receives a signal, via a line 50, from a starter switch 47, which is turned on when the engine is in the starting condition, a signal, via a line 51, from a vehicle stop detector switch 48, which is turned on when the vehicle speed is nearly equal to zero, and a signal, via a line 52, from an air conditioner actuating switch 49, which is turned on when an air conditioner is operated.

In electronic fuel injection control type internal combustion engines of this kind, as is well known, the flow rate of the air sucked into the engine is detected by an air flow sensor 54. Fuel, in an amount which corresponds to the detected flow rate of the intake air, is injected from a fuel injection valve 56 to produce the gas mixture which is fed to a combustion chamber 58. Therefore, if the flow rate of the bypass air through the air bypass passage 16 is controlled by the ACV 18 when the throttle valve 14 is at the idling position, the idling rotational speed of the engine is controlled depending upon the bypass air flow rate.

Figures 2, 2A:
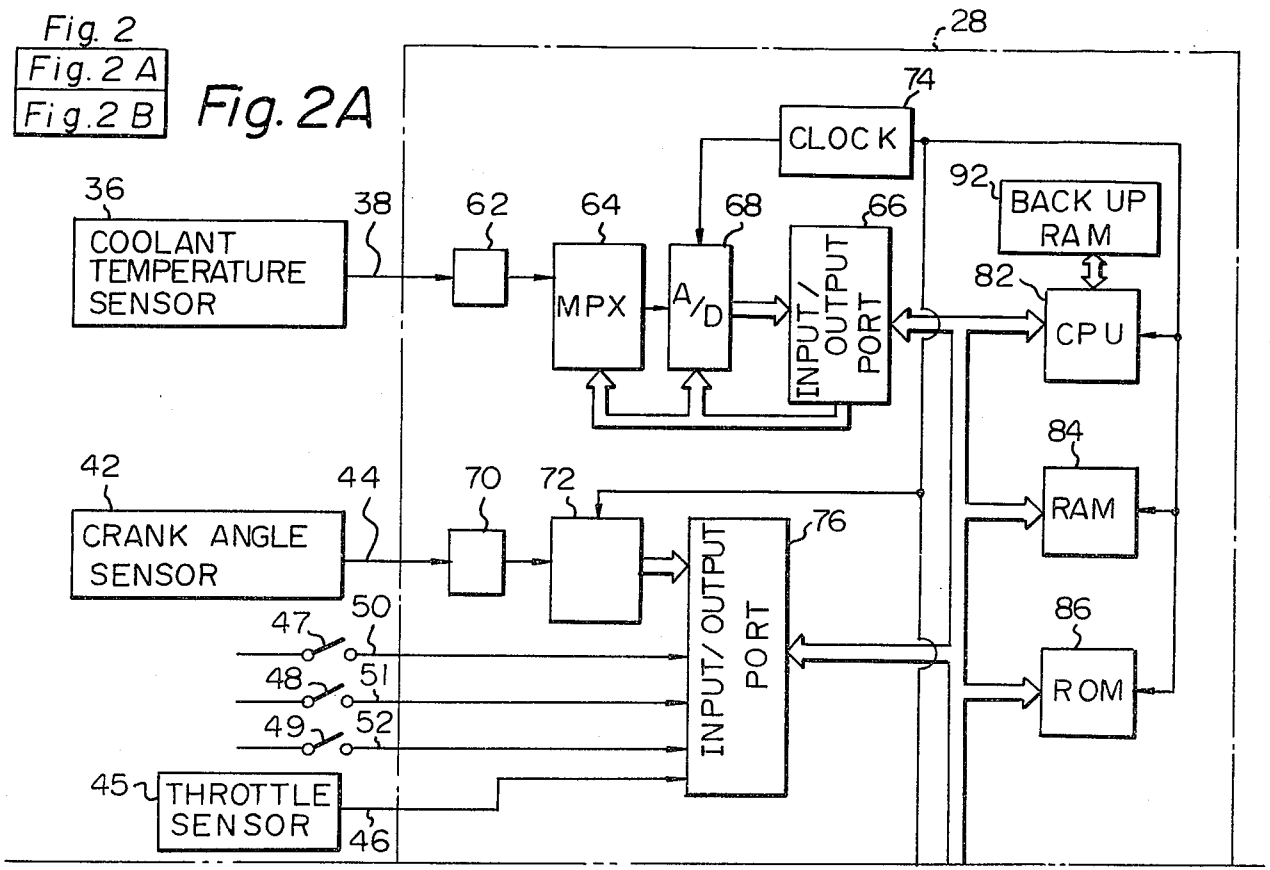
FIG. 2 is a block diagram illustrating a control circuit in the system of FIG. 1.
Figure 2B:
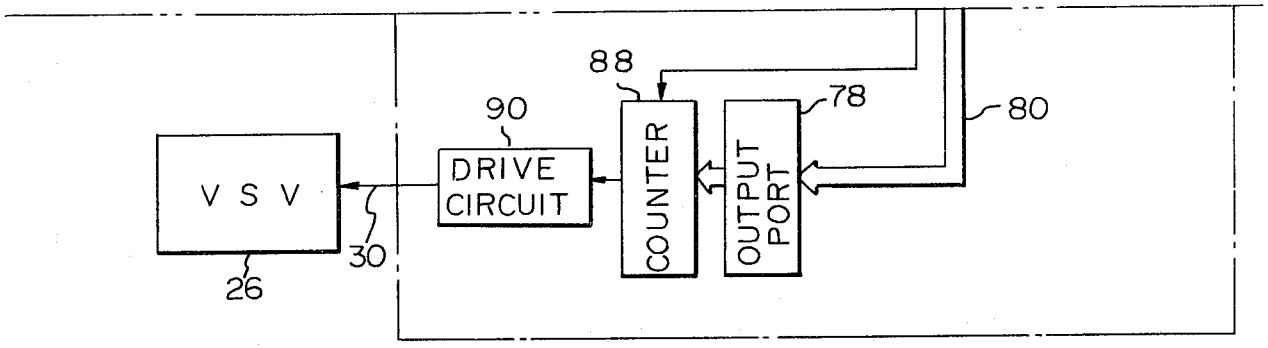

FIG. 2 is a block diagram which illustrates in detail the control circuit 28 of FIG. 1.

Voltage signals from the coolant temperature sensor 36 via a buffer 62 and from other non-diagramed sensors are fed to an analog multiplexer 64, and then fed to an A/D converter 68 in sequence responsive to selection signals from an input/output port 66. In the A/D converter 68, the voltage signals are converted into signals in the form of a binary number. The converted binary signals are fed to the input/output port 66.

A pulse produced by the crank angle sensor 42 at every crank angle of 30° is fed to a speed signal-forming circuit 72 via a buffer 70. The speed signal-forming circuit 72 consists of a gate that is opened and closed by a pulse produced at every crank angle of 30°, and a counter which counts the number of clock pulses applied to the counter from a clock generator circuit 74 via the gate. The speed signal-forming circuit 72 forms speed signals in the form of a binary number which signals represent the actual rotational speed of the engine. The formed binary speed signals are applied to a predetermined bit position of an input/output port 76.

Signals from the throttle position sensor 45, the starter switch 47, the vehicle stop detector switch 48 and the air conditioner actuating switch 49 are applied to predetermined bit positions of the input/output port 76.

The input/output ports 66, 76, and an output port 78, which will be mentioned later, are connected via a bus 80, to a central procesing unit (CPU) 82, a random access memory (RAM) 84, and a read-only memory (ROM) 86, which are major components constituting a microcomputer. The RAM 84 temporarily stores a variety of input data, the data used in the arithmetic calculation, and the results of the arithmetic calculations. In the ROM 86 have been stored beforehand a program for processing the arithmetic calculations that will be mentioned later, and a variety of data necessary for processing the arithmetic calculations.

Furthermore, the microcomputer according to this embodiment is provided with a back-up RAM 92 which consists of a volatile memory that is served with power, even after the ignition switch (not shown) is turned off, or a non-volatile memory which enables the information to be written or erased. The data, which will be used in the next operation of the engine, is stored in the back-up RAM 92 during the previous period of operation of the engine.

A binary control output $D_{out}$ for controlling the VSV 26 is fed from the CPU 82 to the output port 78, and then is set to a presettable down counter 88. The down counter 88 starts to count down the operation with respect to the set content at every predetermined period of time, for example, at every 50 msec. Namely, the down counter 88 reduces the set content one by one to zero, in response to the clock pulses from the clock generator circuit 74. Thus, the output of the high level is fed to a drive circuit 90 during the count down operation. The drive circuit 90 energizes the VSV 26 as far as it is served with the output of the high level. Therefore, the VSV 26 is energized at a duty ratio which corresponds to the control output $D_{out}$. Consequently, the bypass air flow rate is controlled depending upon the control output $D_{out}$.

Figure 3:
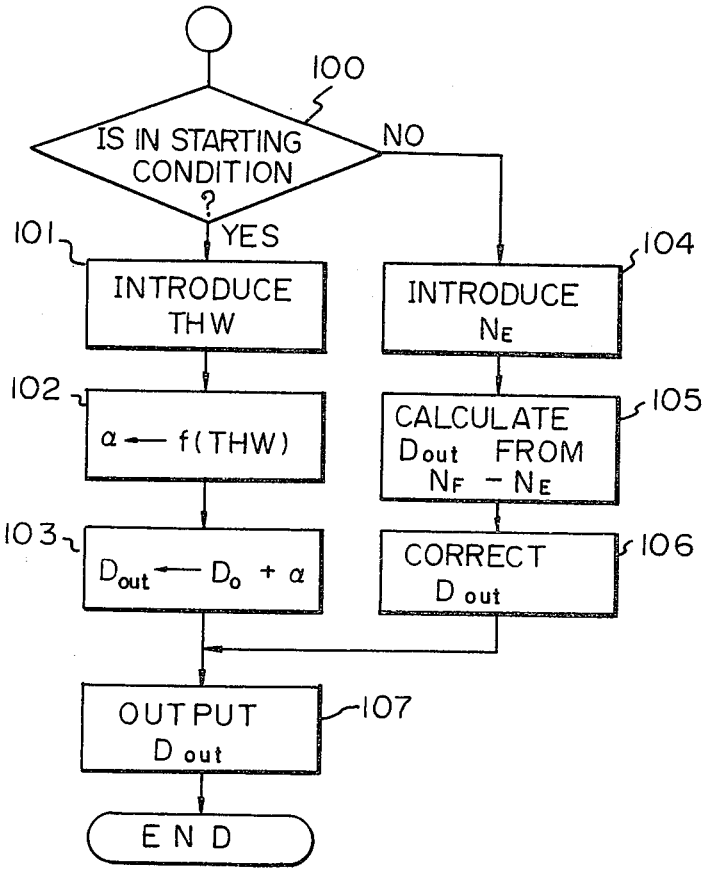
FIGS. 3 and 4 are flow diagrams illustrating the operations of the digital computer in the control circuit of FIG. 2.

Below is illustrated the content of arithmetic calculation executed by the microcomputer. After the ignition switch is turned on and the initial reset operation is established, the CPU 82 executes a processing routine as partly illustrated in FIG. 3, at every predetermined period of time. The arithmetic calculation shown in FIG. 3 is executed in case the data stored in the back-up RAM 92 are not used. The CPU 82 at a point 100 discriminates whether the starter switch 47 is turned on or not, i.e., whether the engine is in the starting condition or not. When in the starting condition, the processing is executed at points 101, 102 and 103. When the engine is not in the starting condition, the processing is executed at points 104, 105 and 106. At the point 101, the CPU 82 introduces the detection data related to the coolant temperature THW, which data is sent from the coolant temperature sensor 36 and which is temporarily stored in the RAM 84. At the next point 102, the CPU 82 calculates an increment value $\alpha$ which depends upon the coolant temperature THW, from a function f (THW) describing a predetermined relationship between the coolant temperatur THW and the increment value $\alpha$. This is carried out in order to vary the increment value $\alpha$ depending upon the warmed-up condition of the engine. Then, at the point 103, the CPU 82 calculates the control output $D_{out}$ relying upon a base value $D_0$ and the increment value $\alpha$, i.e., relying upon a relation $D_{out}=D_0+\alpha$. The base value $D_0$ has been stored beforehand in the ROM 86, and is used as an initial value for calculating the control output $D_{out}$. In the above-mentioned processing routine, although the increment value $\alpha$ is found as a function of the coolant temperature THW, it is, of course, allowable to find the base value $D_0$ as a function of the coolant temperature THW. If the increment value $\alpha$ or the base is found as a function of the coolant temperature THW, the flow rate of the intake air can be changed depending upon whether the engine is started from being cold or is restarted from being sufficiently warmed up.

When the engine is not in the starting condition, the program proceeds to the point 104 as mentioned above. At the point 104, the CPU 82 introduces the detection data that represents an actual rotational speed $N_E$ which has been temporarily stored in a predetermined region of the RAM 84. At the point 105, the CPU 82 calculates the control output $D_{out}$ based on the difference between the actual rotational speed $N_E$ and a desired idling rotational speed $N_F$. The calculation in the point 105 can be performed according to one of the following two methods. One method is to find the control output $D_{out}$ employing a predetermined base value $D_0$ according to a relation, $$D_{out}=D'_{out}+A\cdot(N_F-N_E)$$

where $D'_{out}$ denotes a control output in the previous operation cycle and A denotes a constant. Another method is to find the control output $D_{out}$ according to a relation, $$D_{out}=D_0+B\cdot(N_F-N_E)$$

where B denotes a constant.

In the point 105 as mentioned above, the control output $D_{out}$ is increased or decreased responsive to the difference $N_F-N_E$. At the point 106, then, the CPU 82 corrects the calculated control output $D_{out}$ depending upon whether the air conditioner actuating switch 49 is turned on or off, and depending upon the coolant temperature THW.

At a next point 107, the calculated control output $D_{out}$ is fed to the output port 78 (shown in FIG. 2).

Figure 4:
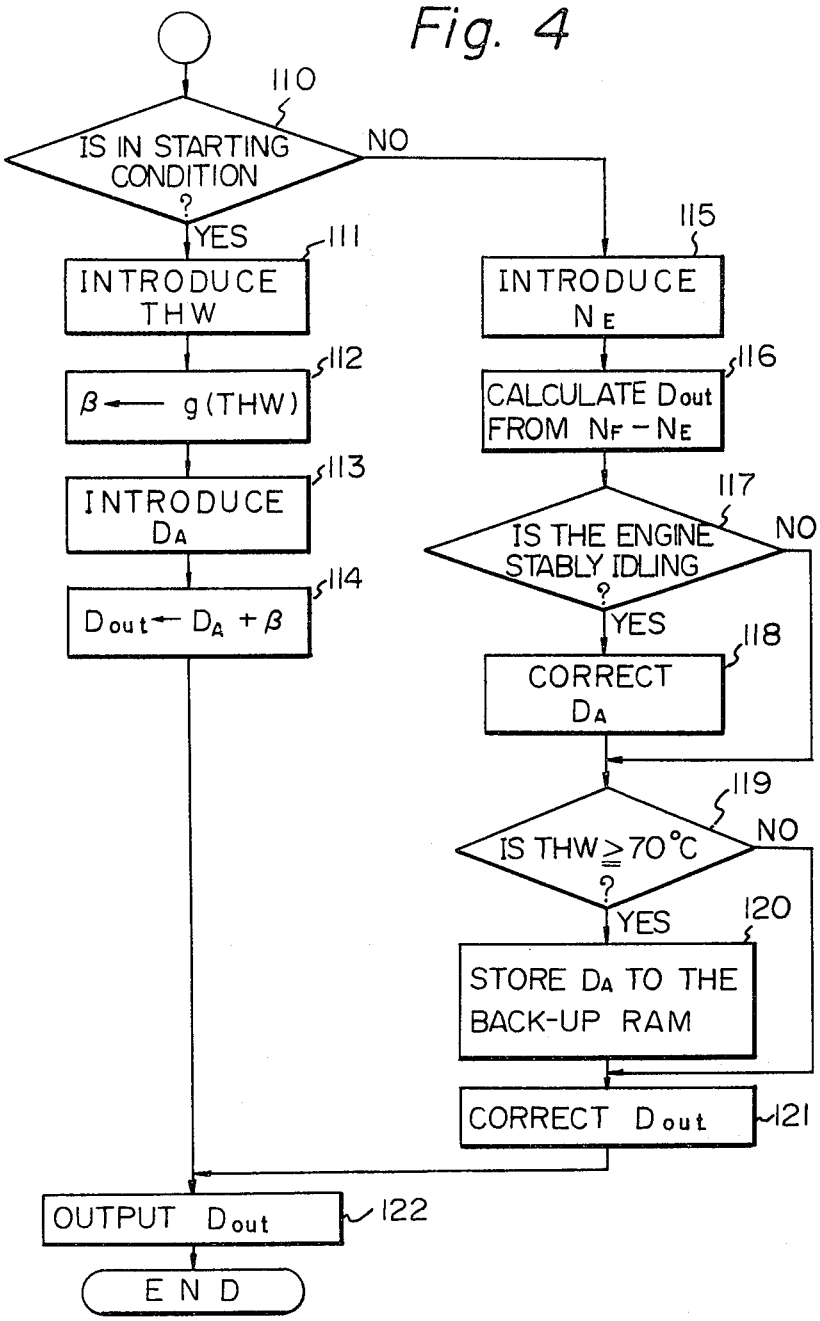

FIG. 4 illustrates a portion of another processing routine for calculating the control output $D_{out}$ by the microcomputer. This processing routine is to calculate the control output $D_{out}$ in case the engine is to be started by using the data which has been stored in the back-up RAM 92. Like at the point 100 in the processing routine of FIG. 3, the CPU 82 at a point 110 discriminates whether the engine is in the starting condition or not. When the engine is in the starting condition, the processing is executed at points 111, 112, 113 and 114. The point 111 works in the same manner as the point 101 of FIG. 3. At the point 112, the CPU 82 calculates an increment value $\beta$ corresponding to the coolant temperature THW from a function g (THW) describing a predetermined relationship between the coolant temperature THW and the increment value $\beta$. This is performed in order to vary the increment value $\beta$ responsive to the warmed-up state of the engine. At the point 113, then, the CPU 82 reads out a value $D_A$ which has been stored in the back-up RAM 92, and at the point 114, calculates the control output $D_{out}$ according to a relation $D_{out}=D_A+\beta$. The above stored value $D_A$ indicates an optimum control output during a stable idling condition, and is found as a value of the control output $D_{out}$ when the engine is in a stable idling condition or as an average value of the control output $D_{out}$ in the stable idling condition.

When the engine is not in the starting condition, the processing is executed at points 115 through 121. The contents processed at the points 115 and 116 are quite the same as those of the points 104 and 105, respectively, of FIG. 3. At the next point 117, the CPU 82 detects whether the throttle valve 14 is at a fully closed position and also if the vehicle speed is nearly zero or not, relying upon the signals from the throttle position sensor 45 and the vehicle stop detector switch 48. Namely, at the point 117, the CPU 82 discriminates whether the engine is in a stable idling condition or not. Only when the engine is in the stable idling condition, the point 118 works to correct the value $D_A$ stored in the back-up RAM 92. This correction is performed by finding a new value $D_A$ from a relation $D_A=(D_A'+D_{out})/2$ relying upon the control output $D_{out}$ calculated at the point 116 and a value $D_A'$ stored in the back-up RAM 92. Then, at the point 119 the CPU 82 discriminates whether the coolant temperature THW is equal to or higher than 70° C. or not, i.e, whether the engine is in a fully warmed-up condition or not. Only when the engine has been completely warmed up, the program proceeds to the point 120 where the value $D_A$ presently found at the point 118 is stored in the back-up RAM 92. At the next point 121, the CPU 82 executes the same processing as that of the point 106 of FIG. 3. Further, the point 122 also performs the same processing as that of the point 107 of FIG. 3.

Figure 5:
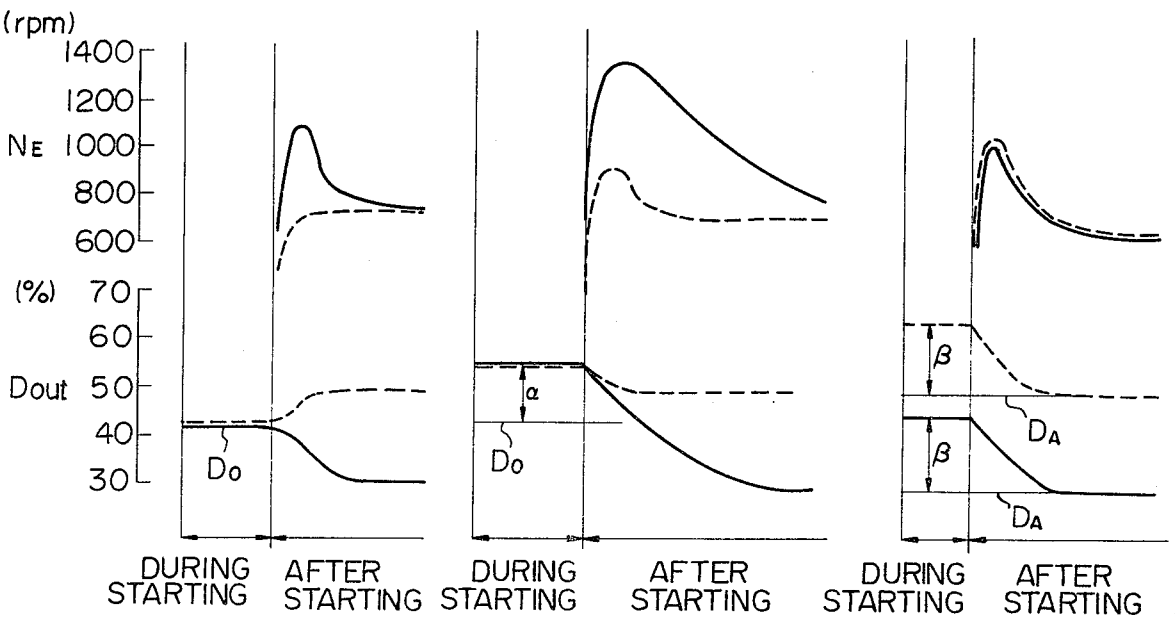
FIG. 5 contains wave forms (A), (B) and (C) for illustrating the effects of the operations according to the programs shown in FIGS. 3 and 4.

According to the above-mentioned processing routines illustrated in FIGS. 3 and 4, in which the control output $D_{out}$ is set to be $D_O+\alpha$ or $D_A+\beta$ when the engine is in the starting condition, it is allowed to enhance the starting performance and to improve the driving feeling during starting and just after starting. The diagrams of FIG. 5 are to explain the above-mentioned reasons, wherein the diagram (A) illustrates the characteristics when the flow rate of the intake air is controlled by the conventional technique, the diagram (B) illustrates the characteristics when the air flow rate is controlled by the processing routine of FIG. 3, and the diagram (C) illustrates the characteristics when the air flow rate is controlled by the processing routine of FIG. 4. In the diagrams (A), (B) and (C) of FIG. 5, curves located on the upper side represent the actual rotational speeds $N_E$, curves located on the lower side represent control outputs $D_{out}$, solid curves represent the cases when the frictional losses of the engine are decreased with the passage of the time, and broken curves represent the characteristics when the intake system is clogged. According to the conventional technique as illustrated in the diagram (A), the control output $D_{out}$ during starting is equal to the reference value $D_0$ and the air is not supplied in increased amounts. Therefore, when the intake system is clogged as indicated by broken curves, the rotational speed $N_E$ of the engine does not smoothly rise immediately after starting, which causes the driver to feel that the engine is out of condition. Further, the engine often comes into a stall when a large load is exerted immediately after starting.

According to the processing routine of FIG. 3 as illustrated in the diagram (B) of FIG. 5, on the other hand, the control output $D_{out}$ during starting is increased by a quantity $\alpha$ as compared with the reference value $D_0$. Therefore, the rotational speed of the engine smoothly rises immediately after starting. Hence, the engine does not come into a stall, the driving feeling is improved, and the starting performance is enhanced. Furthermore, according to the processing routine of FIG. 4 as illustrated in the diagram (C) of FIG. 5, the control output or an average value $D_A$ thereof in the stable idling condition found in the previous time of operation of the engine is further increased by a quantity $\beta$, and the increased value is used as a control output during starting. Therefore, the optimum control is carried out depending upon the operation condition of the engine which changes with the lapse of time. As a result, the driving feeling is improved during starting and immediately after starting, and the starting performance is improved, as well.

According to the present invention, as illustrated in detail in the foregoing, it is possible to improve the starting performance of the engine when the throttle valve is at the fully closed position, and to smoothly and suitably raise the rotational speed of the engine immediately after starting or immediately after re-starting. Consequently, the driving feeling can be greatly improved at starting.

As many widely different embodiments of the present invention may be constructed without departing from the spirit and scope of the present invention, it should be understood that the present invention is not limited to the specific embodiments described in this specification, except as defined in the appended claims.

I claim:

1. A method of controlling the air intake of an internal combustion engine having an intake passage, a throttle valve disposed in the intake passage, and an air bypass passage which interconnects the intake passage at a position located upstream of the throttle valve with the intake passage at a position located located downstream of the throttle valve, said method including the steps of:

detecting the actual rotational speed of the engine to produce a rotational speed signal which corresponds to the detected rotational speed;

by using the produced rotational speed signal, calculating the difference between the actual rotational speed of the engine and a desired idling rotational speed;

calculating a value of a control output signal from said calculated difference;

adjusting, in response to the control output signal, the sectional area of the air bypass passage to control the flow rate of air drawn through the air bypass passage so as to reduce the difference between the actual rotational speed and the desired rotational speed;

detecting whether the engine is in the starting condition or not, to produce a starting condition signal;

in response to the starting condition signal, when the engine is in the starting condition, calculating a modified value of the control output signal by adding an increment value to a base value which corresponds to an optimum control output signal value in the stable idling condition, said base value being a predetermined fixed value; and when the engine is in the starting condition, adjusting, in response to the modified control output signal calculated during the starting condition, the sectional area of the air bypass passage to control the flow rate of air drawn through the air bypass passage.

2. A method of controlling the air intake of an internal combustion engine having an intake passage, a throttle valve disposed in the intake passage, and an air bypass passage which interconnects the intake passage at a position located upstream of the throttle valve with the intake passage at a position located downstream of the throttle valve, said method including the steps of:

detecting the actual rotational speed of the engine to produce a rotational speed signal which corresponds to the detected rotational speed;

by using the produced rotational speed signal, calculating the difference between the actual rotational speed of the engine and a desired idling rotational speed;

calculating a value of a control output signal from said calculated difference;

adjusting, in response to the control output signal, the sectional area of the air bypass passage to control the flow rate of air drawn through the air bypass passage so as to reduce the difference between the actual rotational speed and the desired rotational speed;

detecting whether the engine is in the starting condition or not, to produce a starting condition signal;

calculating an optimum control output signal value in the stable idling condition depending upon said calculated difference;

storing the calculated optimum control output signal value in a store which retains the stored information even when the power switch of the engine is turned off, said stored signal value being used as a base value;

in response to the starting condition signal, when the engine is in the starting condition, calculating a modified value of the control output signal by adding an increment value to said base value; and when the engine is in the starting condition, adjusting, in response to the modified control output signal calculated during the starting condition, the sectional area of the air bypass passage to control the flow rate of air drawn through the air bypass passage.

3. A method as claimed in claim 2, wherein said step of calculating an optimum control output signal value includes a step of calculating an average value of the calculated control output signal value depending upon the calculated difference and the stored signal value which corresponds to the previously calculated optimum control output signal value.

4. A method as claimed in claim 2 or 3, wherein said storing step is performed only when the engine is fully warmed up.

5. A method as claimed in claim 1 or 2, wherein said method further comprising a step of detecting the coolant temperature of the engine to produce a temperature signal which corresponds to the detected coolant temperature, and said increment value is determined in accordance with said temperature signal.

6. Apparatus for controlling the air intake of an internal combustion engine having an intake passage and a throttle valve disposed in the intake passage comprising:

an air bypass passage which interconnects the intake passage at a position located upstream of the throttle valve with the intake passage at a position located downstream of the throttle valve;

means for generating a rotational speed signal related to the actual rotational speed of the engine;

means for detecting whether the engine is in the starting condition or not, to produce a starting condition signal;

controlling means for (1) determining the difference between an actual rotational speed of the engine indicated by said rotational speed signal and a desired idling rotational speed, (2) generating a control output signal from said difference, and (3) in response to the starting condition signal, when the engine is in the starting condition, generating a modified control output signal by adding an increment value to a predetermined fixed base value which corresponds to an optimum control output signal value in the stable idling condition; and means for adjusting, in response to the control output signal when the engine is not in starting condition and in response to the modified control output signal calculated during the starting condition, the sectional area of the air bypass passage to control the flow rate of air drawn through the air bypass passage.

7. Apparatus for controlling the air intake of an internal combustion engine having an intake passage and a throttle valve disposed in the intake passage comprising:

an air bypass passing which interconnects the intake passage at a position located upstream of the throttle valve with the intake passage at a position located downstream of the throttle valve;

means for generating a rotational speed signal related to the actual rotational speed of the engine;

means for detecting whether the engine is in the starting condition or not, to produce a starting condition signal;

means for detecting when said engine is idling stabily;

a memory which retains the stored information even when the power switch to the engine is turned of;

controlling means for (1) determining the difference between an actual rotational speed of the engine indicated by said rotational speed signal and a desired idling rotational speed, (2) generating a control output signal from said difference, (3) determining an optimum control output signal value in the stable idling condition depending upon said difference, (4) storing the optimum control output signal value in said memory, said stored signal value being used as a base value, and (5) in response to the starting condition signal, when the engine is in the starting condition, generating a modified control output signal by adding an increment value to said base value; and means for adjusting, in response to the control output signal when the engine is not in starting condition and in response to the modified control output signal calculated during the starting condition, the sectional area of the air bypass passage to control the flow rate of air drawn through the air bypass passage.

8. Apparatus as in claim 7, wherein when performing the function of determining an optimum control output signal value, said controlling means determines an average value of the calculated control output signal value depending upon the difference and the stored signal value which corresponds to the previously calculated optimum control output signal value.

9. Apparatus as in claim 7 or 8, wherein said controlling means performs said storing function only when the engine is fully warmed up.

10. Apparatus as in claim 6 or 7, wherein:

said apparatus further comprises means for detecting the coolant temperature of the engine; and said controlling means determines said increment value in accordance with said detected temperature.

* * * * *